US008571438B2

(12) United States Patent
Matsushita et al.

(10) Patent No.: US 8,571,438 B2
(45) Date of Patent: Oct. 29, 2013

(54) CHARGING DEVICE AND IMAGE FORMING APPARATUS

(75) Inventors: Kaoru Matsushita, Kanagawa (JP); Kuniaki Tanaka, Kanagawa (JP); Arichika Tanaka, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 131 days.

(21) Appl. No.: 13/209,082

(22) Filed: Aug. 12, 2011

(65) Prior Publication Data

US 2012/0224881 A1 Sep. 6, 2012

(30) Foreign Application Priority Data

Mar. 4, 2011 (JP) ..... 2011-048152

(51) Int. Cl.
*G03G 15/02* (2006.01)

(52) U.S. Cl.
USPC ..... 399/100; 399/171

(58) Field of Classification Search
USPC ..... 399/99, 100, 171
See application file for complete search history.

(56) References Cited

U.S. PATENT DOCUMENTS

2012/0230721 A1* 9/2012 Yamada et al. ..... 399/100

FOREIGN PATENT DOCUMENTS

JP 2009-86091 A 4/2009

* cited by examiner

*Primary Examiner* — David Gray
*Assistant Examiner* — Erika J Villaluna
(74) *Attorney, Agent, or Firm* — Sughrue Mion, PLLC

(57) ABSTRACT

A charging device includes a charging member that charges an outer peripheral surface of a cylindrical latent-image carrier; an electrode member including a curved portion that is formed by press working so as to extend along the outer peripheral surface of the latent-image carrier, the curved portion having an electrode to which a voltage is applied, the electrode being disposed between the charging member and the latent-image carrier; a cleaning member that is movable along the curved portion in an axial direction of the latent-image carrier and that cleans the electrode; and a receiving portion formed in the curved portion at a position outside the electrode, the receiving portion receiving the cleaning member to release a contact pressure between the curved portion and the cleaning member.

4 Claims, 12 Drawing Sheets

CHARGING DEVICE AND IMAGE FORMING APPARATUS

CROSS-REFERENCE TO RELATED APPLICATIONS

This application is based on and claims priority under 35 USC 119 from Japanese Patent Application No. 2011-048152 filed Mar. 4, 2011.

BACKGROUND

The present invention relates to a charging device and an image forming apparatus.

SUMMARY

According to an aspect of the invention, there is provided a charging device including a charging member that charges an outer peripheral surface of a cylindrical latent-image carrier; an electrode member including a curved portion that is formed by press working so as to extend along the outer peripheral surface of the latent-image carrier, the curved portion having an electrode to which a voltage is applied, the electrode being disposed between the charging member and the latent-image carrier; a cleaning member that is movable along the curved portion in an axial direction of the latent-image carrier and that cleans the electrode; and a receiving portion formed in the curved portion at a position outside the electrode, the receiving portion receiving the cleaning member to release a contact pressure between the curved portion and the cleaning member.

BRIEF DESCRIPTION OF THE DRAWINGS

An exemplary embodiment of the present invention will be described in detail based on the following figures, wherein.

DETAILED DESCRIPTION

A charging device and an image forming apparatus according to an exemplary embodiment of the present invention will now be described.

Figure 1:
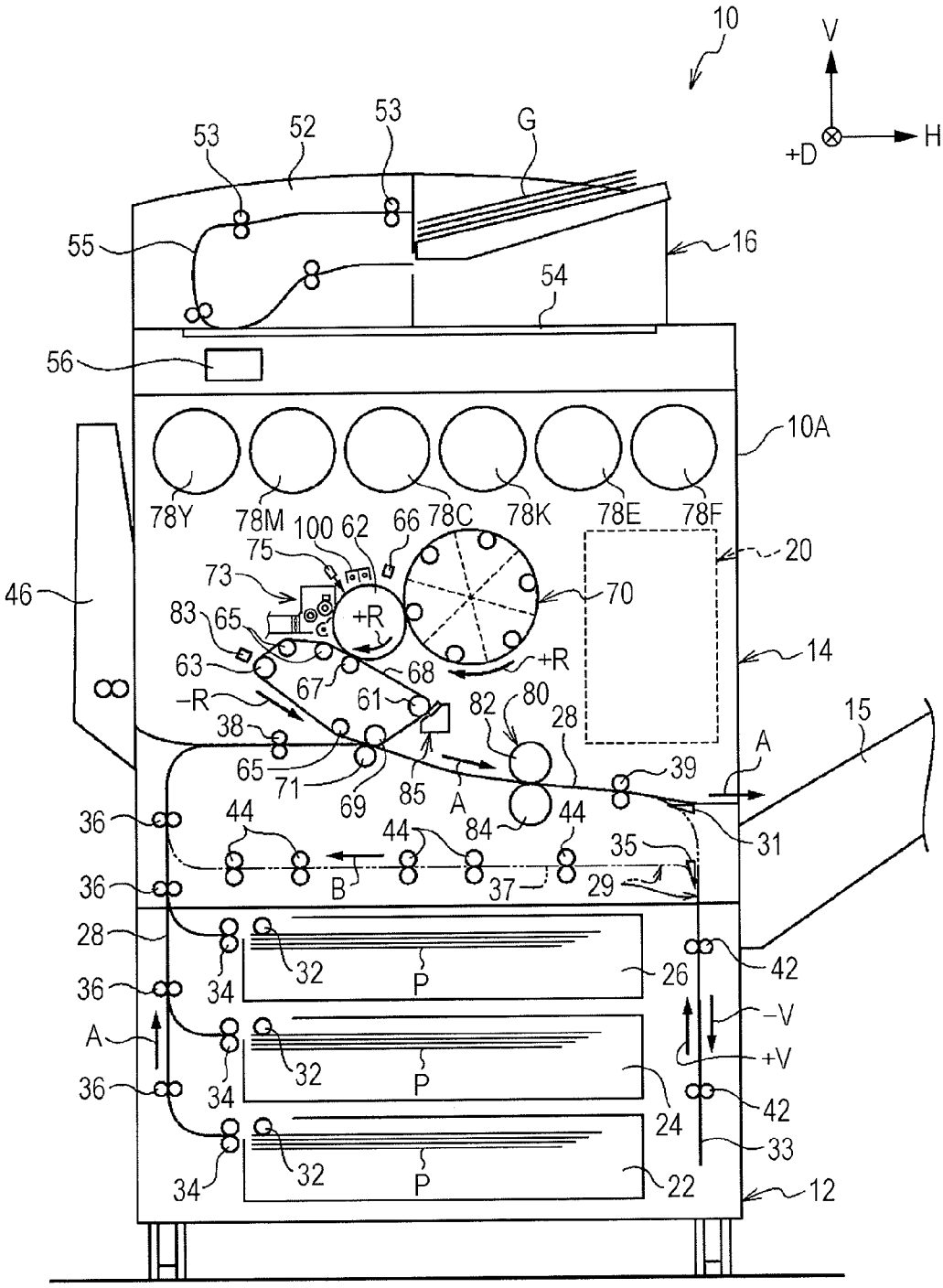
FIG. 1 illustrates the overall structure of an image forming apparatus according to an exemplary embodiment of the present invention.

FIG. 1 illustrates an image forming apparatus 10 according to the exemplary embodiment. The image forming apparatus 10 includes, in order from bottom to top in the vertical direction (direction of arrow V), a sheet storing unit 12 in which recording paper P is stored; an image forming unit 14 which is located above the sheet storing unit 12 and forms images on sheets of recording paper P fed from the sheet storing unit 12; and an original-document reading unit 16 which is located above the image forming unit 14 and reads an original document G. The image forming apparatus 10 also includes a controller 20 that is provided in the image forming unit 14 and controls the operation of each part of the image forming apparatus 10. In the following description, the vertical direction, the left-right (horizontal) direction, and the depth (horizontal) direction with respect to an apparatus body 10A of the image forming apparatus 10 will be referred to as the direction of arrow V, the direction of arrow H, and the direction of arrow +D, respectively.

The sheet storing unit 12 includes a first storage unit 22, a second storage unit 24, and a third storage unit 26 in which sheets of recording paper P, which are examples of recording media, having different sizes are stored. Each of the first storage unit 22, the second storage unit 24, and the third storage unit 26 are provided with a feeding roller 32 that feeds the stored sheets of recording paper P to a transport path 28 in the image forming apparatus 10. Pairs of transport rollers 34 and 36 that transport the sheets of recording paper P one at a time are provided along the transport path 28 in an area on the downstream of each feeding roller 32. A pair of positioning rollers 38 are provided on the transport path 28 at a position downstream of the transport rollers 36 in a transporting direction of the sheets of recording paper P. The positioning rollers 38 temporarily stop each sheet of recording paper P and feed the sheet toward a second transfer position, which will be described below, at a predetermined timing.

In the front view of the image forming apparatus 10, an upstream part of the transport path 28 linearly extends in the direction of arrow V from the left side of the sheet storing unit 12 to the lower left part of the image forming unit 14. A downstream part of the transport path 28 extends from the lower left part of the image forming unit 14 to a paper output unit 15 provided on the right side of the image forming unit 14. A duplex-printing transport path 29, which is provided for reversing and transporting each sheet of recording paper P in a duplex printing process, is connected to the transport path 28.

In the front view of the image forming apparatus 10, the duplex-printing transport path 29 includes a first switching member 31, a reversing unit 33, a transporting unit 37, and a second switching member 35. The first switching member 31 switches between the transport path 28 and the duplex-printing transport path 29. The reversing unit 33 extends linearly in the direction of arrow −V (downward in FIG. 1) from a lower right part of the image forming unit 14 along the right side of the sheet storing unit 12. The transporting unit 37 receives the trailing end of each sheet of recording paper P that has been transported to the reversing unit 33 and transports the sheet in the direction of arrow H (leftward in FIG. 1). The second switching member 35 switches between the reversing unit 33 and the transporting unit 37. The reversing unit 33 includes plural pairs of transport rollers 42 that are arranged with intervals therebetween, and the transporting unit 37 includes plural pairs of transport rollers 44 that are arranged with intervals therebetween.

The first switching member 31 has the shape of a triangular prism, and a point end of the first switching member 31 is moved by a driving unit (not shown) to one of the transport path 28 and the duplex-printing transport path 29. Thus, the transporting direction of each sheet of recording paper P is changed. Similarly, the second switching member 35 has the shape of a triangular prism, and a point end of the second switching member 35 is moved by a driving unit (not shown) to one of the reversing unit 33 and the transporting unit 37. Thus, the transporting direction of each sheet of recording paper P is changed. The downstream end of the transporting unit 37 is connected to the transport path 28 by a guiding member (not shown) at a position in front of the transport rollers 36 in the upstream part of the transport path 28. A foldable manual sheet-feeding unit 46 is provided on the left side of the image forming unit 14. The manual sheet-feeding unit 46 is connected to the transport path 28 at a position in front of the positioning rollers 38.

The original-document reading unit 16 includes a document transport device 52 that automatically transports the sheets of the original document G one at a time; a platen glass 54 which is located below the document transport device 52 and on which the sheets of the original document G are placed one at a time; and an original-document reading device 56 that scans each sheet of the original document G while the sheet is being transported by the document transport device 52 or placed on the platen glass 54.

The document transport device 52 includes an automatic transport path 55 along which pairs of transport rollers 53 are arranged. A part of the automatic transport path 55 is arranged such that each sheet of the original document G moves along the top surface of the platen glass 54. The original-document reading device 56 scans each sheet of the original document G that is being transported by the document transport device 52 while being stationary at the left edge of the platen glass 54. Alternatively, the original-document reading device 56 scans each sheet of the original document G placed on the platen glass 54 while moving in the direction of arrow H.

The image forming unit 14 includes a cylindrical photoconductor 62, which is an example of a latent-image carrier, disposed in a central area of the apparatus body 10A. The photoconductor 62 is rotated in the direction shown by arrow +R (clockwise in FIG. 1) by a driving unit (not shown), and carries an electrostatic latent image formed by irradiation with light. In addition, a scorotron charging unit 100, which is an example of a charging device that charges the surface of the photoconductor 62, is provided above the photoconductor 62 so as to face the outer peripheral surface of the photoconductor 62. The charging unit 100 will be described in detail below.

Figure 2:
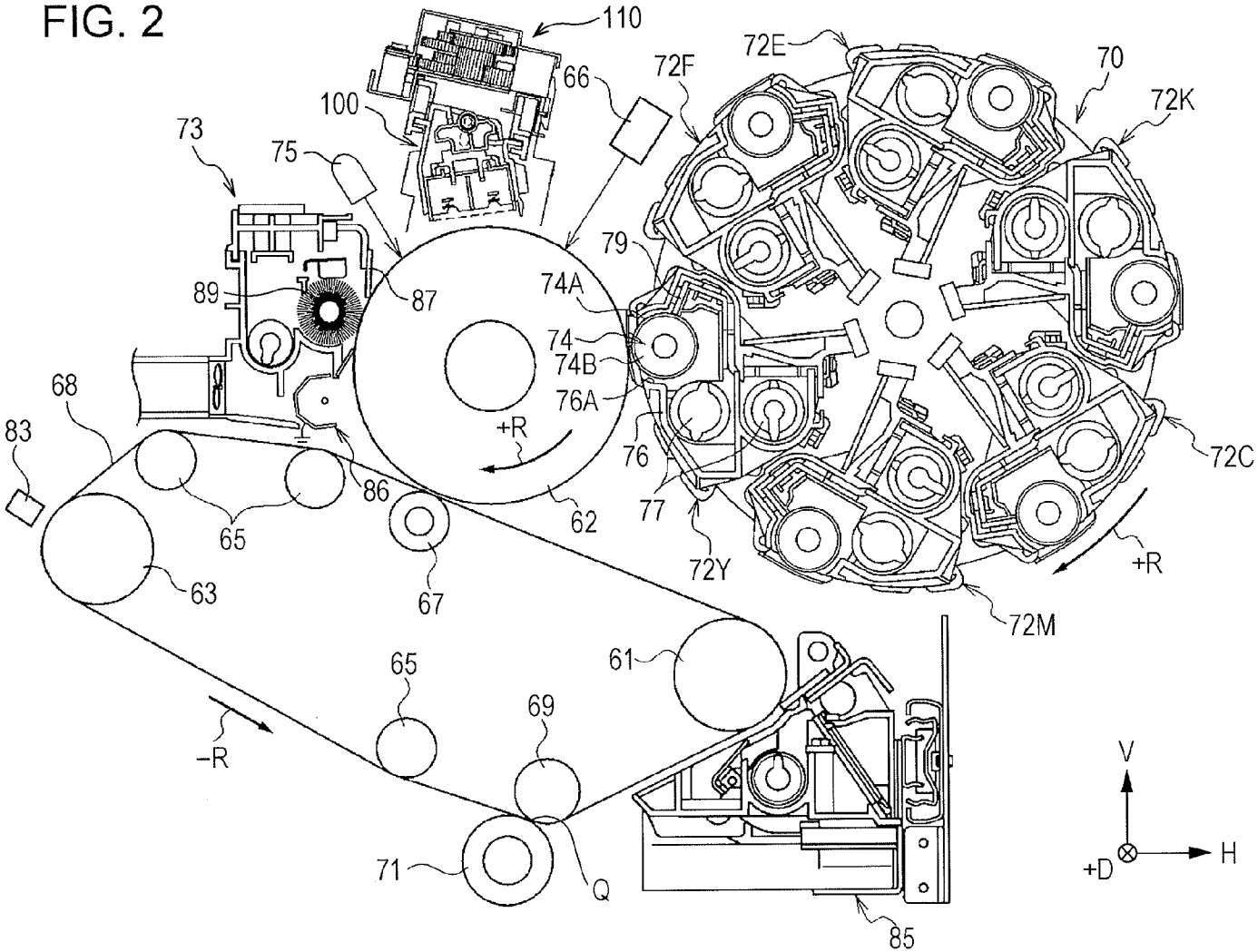
FIG. 2 illustrates the structure of an image forming unit according to the exemplary embodiment of the present invention.

As illustrated in FIG. 2, an exposure device 66 is provided so as to face the outer peripheral surface of the photoconductor 62 at a position downstream of the charging unit 100 in the rotational direction of the photoconductor 62. The exposure device 66 includes a light emitting diode (LED). The outer peripheral surface of the photoconductor 62 that has been charged by the charging unit 100 is irradiated with light (exposed to light) by the exposure device 66 on the basis of an image signal corresponding to each color of toner. Thus, an electrostatic latent image is formed. The exposure device 66 is not limited to those including LEDs. For example, the exposure device 66 may be structured such that the outer peripheral surface of the photoconductor 62 is scanned with a laser beam by using a polygon mirror.

A rotation-switching developing device 70, which is an example of a developing member, is provided downstream of a position where the photoconductor 62 is irradiated with exposure light by the exposure device 66 in the rotational direction of the photoconductor 62. The developing device 70 visualizes the electrostatic latent image on the outer peripheral surface of the photoconductor 62 by developing the electrostatic latent image with toner of each color.

An intermediate transfer belt 68 is provided downstream of the developing device 70 in the rotational direction of the photoconductor 62 and below the photoconductor 62. A toner image formed on the outer peripheral surface of the photoconductor 62 is transferred onto the intermediate transfer belt 68. The intermediate transfer belt 68 is an endless belt, and is wound around a driving roller 61 that is rotated by the controller 20, a tension-applying roller 63 that applies a tension to the intermediate transfer belt 68, plural transport rollers 65 that are in contact with the back surface of the intermediate transfer belt 68 and are rotationally driven, and an auxiliary roller 69 that is in contact with the back surface of the intermediate transfer belt 68 at the second transfer position, which will be described below, and is rotationally driven. The intermediate transfer belt 68 is rotated in the direction shown by arrow −R (counterclockwise in FIG. 2) when the driving roller 61 is rotated.

A first transfer roller 67 is opposed to the photoconductor 62 with the intermediate transfer belt 68 interposed therebetween. The first transfer roller 67 performs a first transfer process in which the toner image formed on the outer peripheral surface of the photoconductor 62 is transferred onto the intermediate transfer belt 68. The first transfer roller 67 is in contact with the back surface of the intermediate transfer belt 68 at a position downstream of the position where the photoconductor 62 is in contact with the intermediate transfer belt 68 in the moving direction of the intermediate transfer belt 68. The first transfer roller 67 receives electricity from a power source (not shown), so that a potential difference is generated between the first transfer roller 67 and the photoconductor 62, which is grounded. Thus, the first transfer process is carried out in which the toner image on the photoconductor 62 is transferred onto the intermediate transfer belt 68.

A second transfer roller 71, which is an example of a transfer member, is opposed to the auxiliary roller 69 with the intermediate transfer belt 68 interposed therebetween. The second transfer roller 71 performs a second transfer process in which toner images that have been transferred onto the intermediate transfer belt 68 in the first transfer process are transferred onto the sheet of recording paper P. The position between the second transfer roller 71 and the auxiliary roller 69 serves as the second transfer position (position Q in FIG. 2) at which the toner images are transferred onto the sheet of recording paper P. The second transfer roller 71 is in contact with the intermediate transfer belt 68. The second transfer roller 71 receives electricity from a power source (not shown), so that a potential dereference is generated between the second transfer roller 71 and the auxiliary roller 69, which is grounded. Thus, the second transfer process is carried out in which the toner images on the intermediate transfer belt 68 are transferred onto the sheet of recording paper P.

A cleaning device 85 is opposed to the driving roller 61 with the intermediate transfer belt 68 interposed therebetween. The cleaning device 85 collects residual toner that remains on the intermediate transfer belt 68 after the second transfer process. A position detection sensor 83 is opposed to the tension-applying roller 63 at a position outside the intermediate transfer belt 68. The position detection sensor 83 detects a predetermined reference position on the surface of the intermediate transfer belt 68 by detecting a mark (not shown) on the intermediate transfer belt 68. The position detection sensor 83 outputs a position detection signal that serves as a reference for the time to start an image forming process.

A cleaning device 73 is provided downstream of the first transfer roller 67 in the rotational direction of the photoconductor 62. The cleaning device 73 removes residual toner and the like that remain on the surface of the photoconductor 62 instead of being transferred onto the intermediate transfer belt 68 in the first transfer process. The cleaning device 73 collects the residual toner and the like with a cleaning blade 87 and a brush roller 89 (see FIG. 2) that are in contact with the surface of the photoconductor 62.

An erase device 86 (see FIG. 2) is provided upstream of the cleaning device 73 and downstream of the first transfer roller 67 in the rotational direction of the photoconductor 62. The erase device 86 removes the electric charge by irradiating the outer peripheral surface of the photoconductor 62 with light. The erase device 86 removes the electric charge by irradiating the outer peripheral surface of the photoconductor 62 with light before the residual toner and the like are collected by the cleaning device 73. Accordingly, the electrostatic adhesive force is reduced and the collection rate of the residual toner and the like is increased. An erase lamp 75 for removing the electric charge after the collection of the residual toner and the like may be provided downstream of the cleaning device 73 and upstream of the charging unit 100.

The second transfer position at which the toner images are transferred onto the sheet of recording paper P by the second transfer roller 71 is at an intermediate position of the above-described transport path 28. A fixing device 80 is provided on the transport path 28 at a position downstream of the second transfer roller 71 in the transporting direction of the sheet of recording paper P (direction shown by arrow A). The fixing device 80 fixes the toner images that have been transferred onto the sheet of recording paper P by the second transfer roller 71.

The fixing device 80 includes a heating roller 82 and a pressing roller 84. The heating roller 82 is disposed at the side of the sheet of recording paper P at which the toner images are formed (upper side), and includes a heat source which generates heat when electricity is supplied thereto. The pressing roller 84 is positioned below the heating roller 82, and presses the sheet of recording paper P against the outer peripheral surface of the heating roller 82. Transport rollers 39 that transport the sheet of recording paper P to the paper output unit 15 or the reversing unit 33 are provided on the transport path 28 at a position downstream of the fixing device 80 in the transporting direction of the sheet of recording paper P.

Toner cartridges 78Y, 78M, 78C, 78K, 78E, and 78F that respectively contain yellow (Y) toner, magenta (M) toner, cyan (C) toner, black (K) toner, toner of a first specific color (E), and toner of a second specific color (F) are arranged in the direction shown by arrow H in a replaceable manner in an area below the original-document reading device 56 and above the developing device 70. The first and second specific colors E and F may be selected from specific colors (including transparent) other than yellow, magenta, cyan, and black. Alternatively, the first and second specific colors E and F are not selected.

When the first and second specific colors E and F are selected, the developing device 70 performs the image forming process using six colors, which are Y, M, C, K, E, and F. When the first and second specific colors E and F are not selected, the developing device 70 performs the image forming process using four colors, which are Y, M, C, and K. In the present exemplary embodiment, the case in which the image forming process is performed using the four colors, which are Y, M, C, and K, and the first and second specific colors E and F are not used will be described as an example. However, as another example, the image forming process may be performed using five colors, which are Y, M, C, K, and one of the first and second specific colors E and F.

As illustrated in FIG. 2, the developing device 70 includes developing units 72Y, 72M, 72C, 72K, 72E, and 72F corresponding to the respective colors, which are yellow (Y), magenta (M), cyan (C), black (K), the first specific color (E), and the second specific color (F), respectively. The developing units 72Y, 72M, 72C, 72K, 72E, and 72F are arranged in that order in a circumferential direction (counterclockwise). The developing device 70 is rotated by a motor (not shown), which is an example of a rotating unit, in steps of 60°. Accordingly, one of the developing units 72Y, 72M, 72C, 72K, 72E, and 72F that is to perform a developing process is selectively opposed to the outer peripheral surface of the photoconductor 62. The developing units 72Y, 72M, 72C, 72K, 72E, and 72F have similar structures. Therefore, only the developing unit 72Y will be described, and explanations of the other developing units 72M, 72C, 72K, 72E, and 72F will be omitted.

The developing unit 72Y includes a casing member 76, which serves as a base body. The casing member 76 is filled with developer (not shown) including toner and carrier. The developer is supplied from the toner cartridge 78Y (see FIG. 1) through a toner supply channel (not shown). The casing member 76 has a rectangular opening 76A that is opposed to the outer peripheral surface of the photoconductor 62. A developing roller 74 is disposed in the opening 76A so as to face the outer peripheral surface of the photoconductor 62. A plate-shaped regulating member 79, which regulates the thickness of a developer layer, is provided along the longitudinal direction of the opening 76A at a position near the opening 76A in the casing member 76.

The developing roller 74 includes a rotatable cylindrical developing sleeve 74A and a magnetic unit 74B fixed to the inner surface of the developing sleeve 74A and including plural magnetic poles. A magnetic brush made of the developer (carrier) is formed as the developing sleeve 74A is rotated, and the thickness of the magnetic brush is regulated by the regulating member 79. Thus, the developer layer is formed on the outer peripheral surface of the developing sleeve 74A. The developer layer on the outer peripheral surface of the developing sleeve 74A is moved to the position where the developing sleeve 74A faces the photoconductor 62. Accordingly, the toner adheres to the latent image (electrostatic latent image) formed on the outer peripheral surface of the photoconductor 62. Thus, the latent image is developed.

Two helical transport rollers 77 are rotatably arranged in parallel to each other in the casing member 76. The two transport rollers 77 rotate so as to circulate the developer contained in the casing member 76 in the axial direction of the developing roller 74 (long-side direction longitudinal direction of the developing unit 72Y). Six developing rollers 74 are included in the respective developing units 72Y, 72M, 72C, 72K, 72E, and 72F, and are arranged along the circumferential direction so as to be separated form each other by 60° in terms of the central angle. When the developing units 72 are switched, the developing roller 74 in the newly selected developing unit 72 is caused to face the outer peripheral surface of the photoconductor 62.

An image forming process performed by the image forming apparatus 10 will be described.

Referring to FIG. 1, when the image forming apparatus 10 is activated, image data of respective colors, which are yellow (Y), magenta (M), cyan (C), black (K), the first specific color (E), and the second specific color (F), are successively output to the exposure device 66 from an image processing device (not shown) or an external device. At this time, the developing device 70 is held such that the developing unit 72Y, for example, is opposed to the outer peripheral surface of the photoconductor 62 (see FIG. 2).

Next, electricity is applied to charge wires 102A and 102B (see FIG. 3) in the charging unit 100, so that a potential difference is generated between the charge wires 102A and 102B the photoconductor 62 that is grounded. Accordingly, corona discharge occurs and the outer peripheral surface of the photoconductor 62 is charged. At this time, a bias voltage is applied to the grid electrode 104 (see FIG. 3), so that the charge potential (discharge current) of the photoconductor 62 is within an allowable range.

The exposure device 66 emits light in accordance with the image data, and the outer peripheral surface of the photoconductor 62, which has been charged by the charging unit 100, is exposed to the emitted light. Accordingly, an electrostatic latent image corresponding to the yellow image data is formed on the surface of the photoconductor 62. The electrostatic latent image formed on the surface of the photoconductor 62 is developed as a yellow toner image by the developing unit 72Y. The yellow toner image on the surface of the photoconductor 62 is transferred onto the intermediate transfer belt 68 by the first transfer roller 67.

Then, referring to FIG. 2, the developing device 70 is rotated by 60° in the direction shown by arrow +R, so that the developing unit 72M is opposed to the surface of the photoconductor 62. Then, the charging process, the exposure process, and the developing process are performed so that a magenta toner image is formed on the surface of the photoconductor 62. The magenta toner image is transferred onto the yellow toner image on the intermediate transfer belt 68 by the first transfer roller 67. Similarly, cyan (C) and black (K) toner images are successively transferred onto the intermediate transfer belt 68, and toner images of the first specific color (E) and the second specific color (F) are additionally transferred onto the intermediate transfer belt 68 depending on the color setting.

A sheet of recording paper P is fed from the sheet storing unit 12 and transported along the transport path 28, as illustrated in FIG. 1. Then, the sheet is transported by the positioning rollers 38 to the second transfer position (position Q in FIG. 2) in synchronization with the time at which the toner images are transferred onto the intermediate transfer belt 68 in a superimposed manner. Then, the second transfer process is performed in which the toner images that have been transferred onto the intermediate transfer belt 68 in a superimposed manner are transferred by the second transfer roller 71 onto the sheet of recording paper P that has been transported to the second transfer position.

The sheet of recording paper P onto which the toner images have been transferred is transported toward the fixing device 80 in the direction shown by arrow A (rightward in FIG. 1). The fixing device 80 fixes the toner images to the sheet of recording paper P by applying heat and pressure thereto with the heating roller 82 and the pressing roller 84. The sheet of recording paper P to which the toner images are fixed is ejected to, for example, the paper output unit 15.

When images are to be formed on both sides of the sheet of recording paper P, the following process is performed. That is, after the toner images on the front surface of the sheet of recording paper P are fixed by the fixing device 80, the sheet is transported to the reversing unit 33 in the direction shown by arrow −V. Then, the sheet of recording paper P is transported in the direction shown by arrow +V, so that the leading and trailing edges of the sheet of recording paper P are reversed. Then, the sheet of recording paper P is transported along the duplex-printing transport path 29 in the direction shown by arrow B (leftward in FIG. 1), and is inserted into the transport path 28. Then, the back surface of the sheet of recording paper P is subjected to the image forming process and the fixing process.

Next, the charging unit 100 and an attachment structure for the charging unit 100 will be described.

Figure 3:
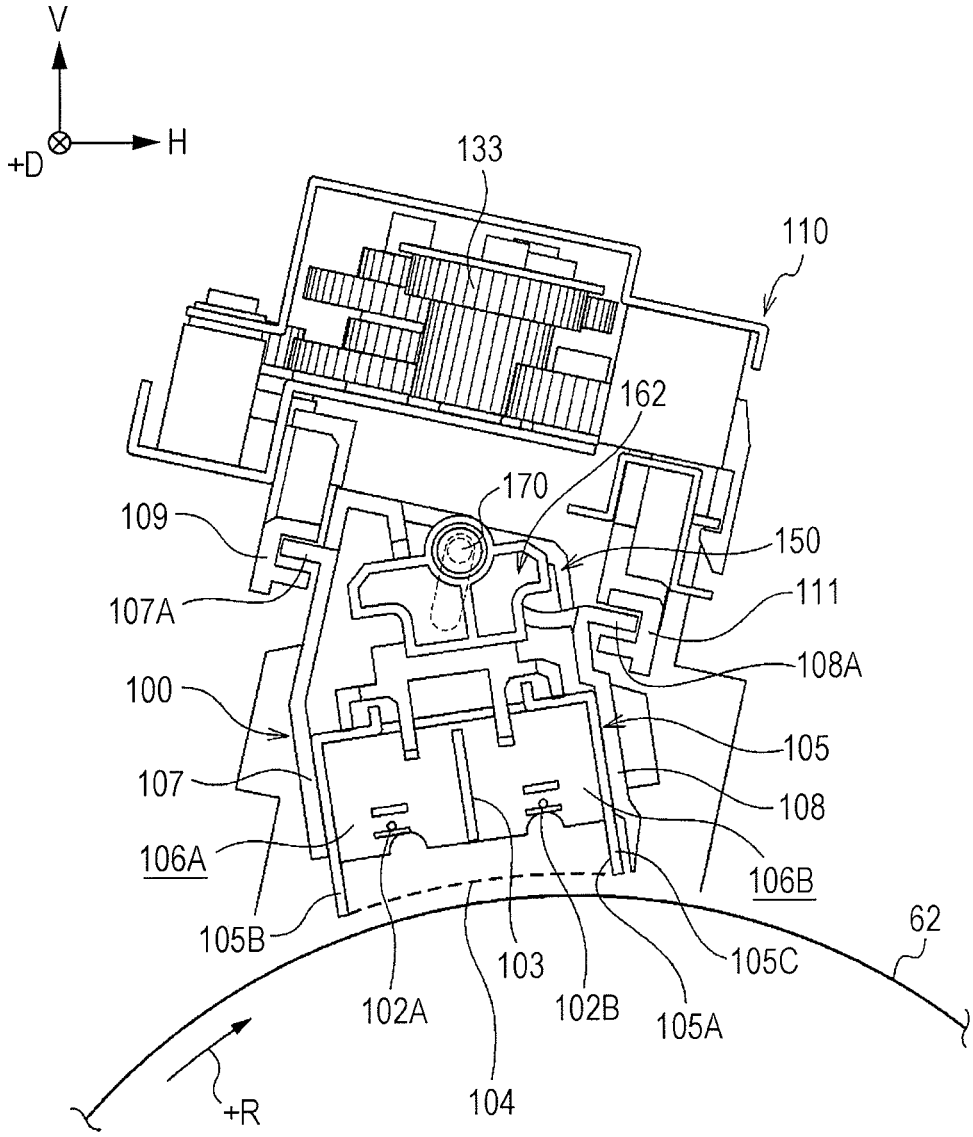
FIG. 3 illustrates the structure of an area around a photoconductor according to the exemplary embodiment of the present invention.

As illustrated in FIG. 3, the charging unit 100 includes a shielding member 105 that is angular U-shaped in the H-V plane (cross section). The inner space of the shielding member 105 is divided into chambers 106A and 106B with a partition plate 103 that stands so as to extend in the direction shown by arrow +D. The chamber 106A is at the upstream side in the direction shown by arrow +R, and the chamber 106B is at the downstream side in the direction shown by arrow +R. The shielding member 105 has, for example, an opening 105A that faces the outer peripheral surface of the photoconductor 62.

The charge wire 102A, which is an example of a charging member, is disposed in the chamber 106A so as to extend in the direction shown by arrow +D. Similarly, the charge wire 102B, which is also an example of a charging member, is disposed in the chamber 106B so as to extend in the direction shown by arrow +D. The grid electrode 104, which is an example of an electrode member, is attached to the shielding member 105 so as to cover the opening 105A. The grid electrode 104 is disposed between the charge wires 102A and 102B and the outer peripheral surface of the photoconductor 62 in the H-V plane. The grid electrode 104 and a grid cleaner 150, which cleans the grid electrode 104, will be described in detail below.

Cover members 107 and 108 that stand in the direction shown by arrow V are attached to outer surfaces of a pair of side walls 105B and 105C of the shielding member 105 that face each other in the direction shown by arrow H. The cover member 107 is bent outward (leftward in FIG. 3) into the shape of the letter 'L' at the top end thereof, and thus a plate-shaped guide member 107A is formed. The cover member 108 is bent outward (rightward in FIG. 3) into the shape of the letter 'L' at the top end thereof, and thus a plate-shaped guide member 108A is formed. The guide members 107A and 108A are guided in the direction shown by arrow +D and retained (restrained from being moved) in the directions shown by arrows H and V by guide rails 109 and 111, which will be described below. Accordingly, the charging unit 100 is disposed so as to face the outer peripheral surface of the photoconductor 62.

Figure 4:
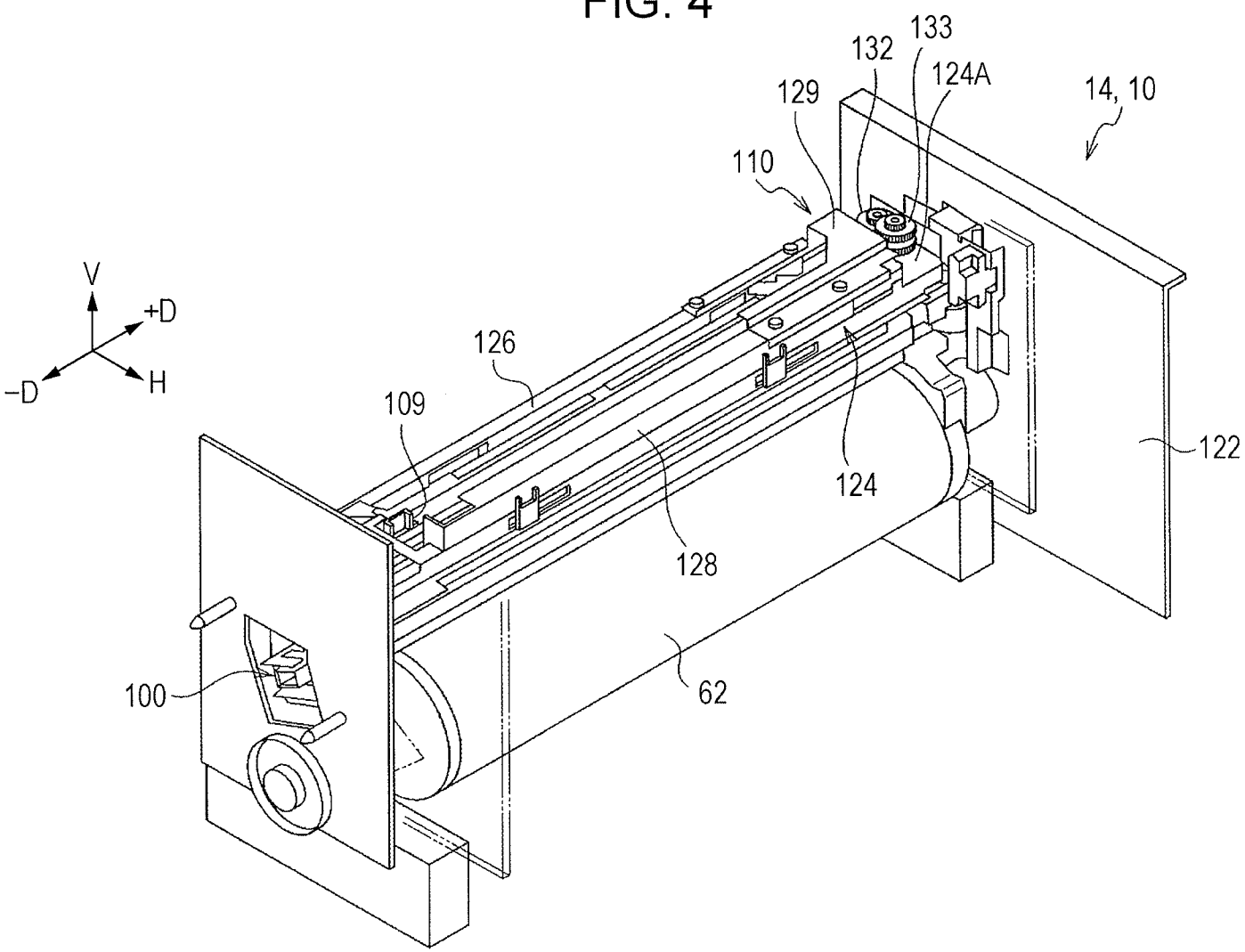
FIG. 4 is a perspective view illustrating the arrangement of the photoconductor and the charging unit according to the exemplary embodiment of the present invention.

As illustrated in FIG. 4, an attachment portion 110 to which the charging unit 100 is attached is provided above the photoconductor 62 in the direction shown by arrow V. The attachment portion 110 includes a base plate 124; slide members 126 and 128 which have a rectangular parallelepiped shape and are movable along the base plate 124 in the direction shown by arrow +D (or in the direction shown by arrow −D); a motor 132 which serves as a drive source for moving the slide members 126 and 128; and the guide rails 109 and 111 (see FIG. 3) which vertically move along the direction shown by arrow V in response to the movements of the slide members 126 and 128.

A flat portion 124A is provided at an end of the base plate 124. The motor 132 and a gear train 133, which transmits the driving force of the motor 132 to the slide member 128 as described below, are placed on the flat portion 124A.

When the attachment portion 110 is viewed in the direction shown by arrow +D, the slide member 126 is retained on the top surface of the base plate 124 at the left end thereof such that the slide member 126 is slidable in the direction shown by arrow +D, and the slide member 128 is retained on the top surface of the base plate 124 at the right end thereof such that the slide member 128 is slidable in the direction shown by arrow +D. A connecting member 129 is fixed with screws to the top surfaces of the slide members 126 and 128. Since the connecting member 129 is fixed to the top surfaces of the slide members 126 and 128, the slide members 126 and 128 move together in the direction shown by arrow +D or the direction shown by arrow −D.

Figure 5A:
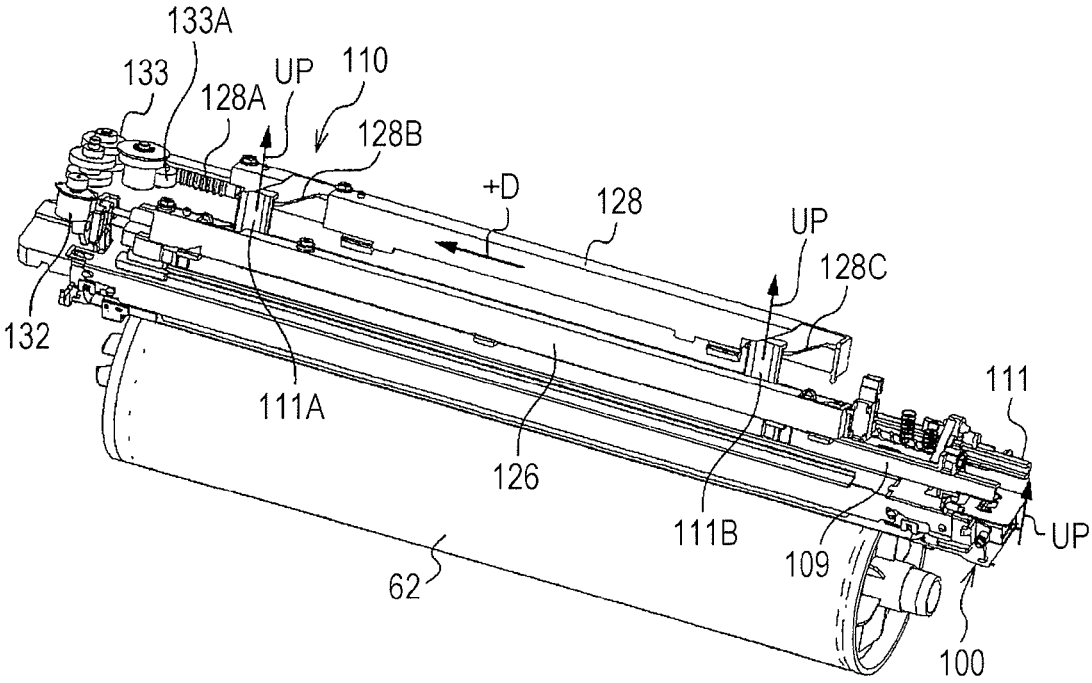
FIG. 5A illustrates the state in which the charging unit is near the photoconductor according to the exemplary embodiment of the present invention.
Figure 5B:
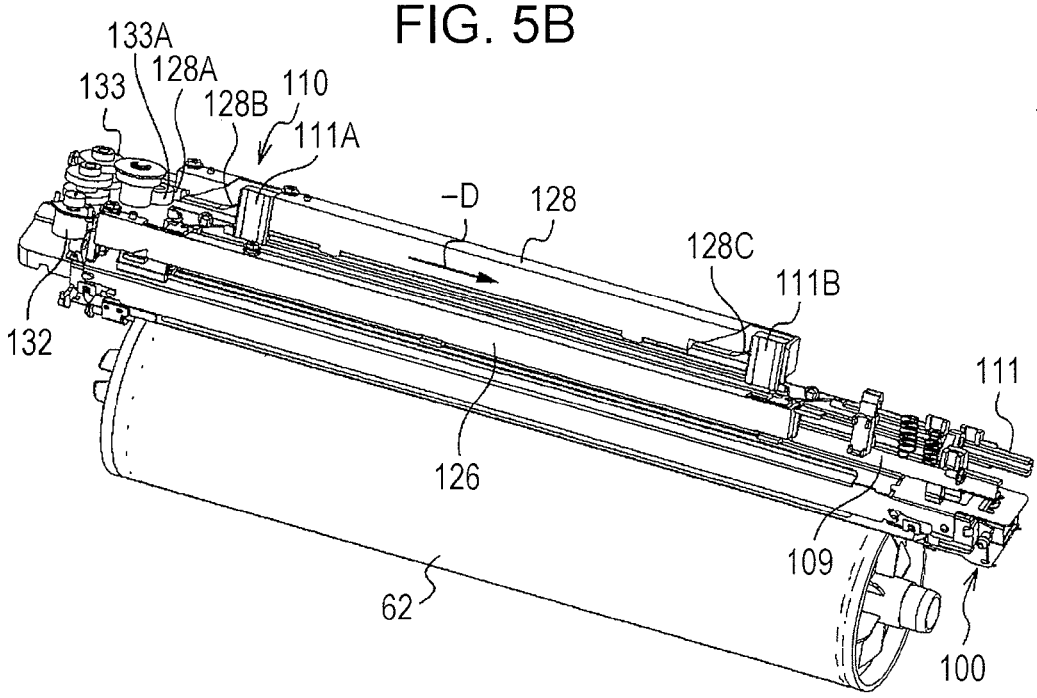
FIG. 5B illustrates the state in which the charging unit is separated from the photoconductor according to the exemplary embodiment of the present invention.

Referring to FIGS. 5A and 5B, the slide member 128 is provided with a rack portion 128A disposed near the gear train 133 and cam portions 128B and 128C arranged in the direction shown by arrow +D with an interval therebetween. The rack portion 128A meshes with a pinion 133A, which is one of gears included in the gear train 133. The rack portion 128A is linearly moved in the direction shown by arrow +D or the direction shown by arrow −D in response to a rotation of the pinion 133A. Each of the cam portions 128B and 128C includes an inclined portion which is inclined obliquely downward with respect to the direction shown by arrow +D and upper and lower flat portions which continuously extend from the top end and the bottom end, respectively, of the inclined portion.

The guide rail 111, which guides the charging unit 100 in the direction shown by arrow +D and retains the charging unit 100 above the photoconductor 62, is provided at the bottom of the slide member 128. Hook portions 111A and 111B are provided on the guide rail 111 with an interval therebetween in the direction shown by arrow +D. The hook portions 111A and 111B have the shape of an inverted letter 'L' when viewed in the direction shown by arrow +D, and flat portions at the top thereof are engaged with the cam portions 128B and 128C of the slide member 128. The hook portions 111A and 111B are positioned at the bottom ends of the cam portions 128B and 128C when the image forming process is performed.

In the above-described structure, when the slide member 128 is moved in the direction shown by arrow +D in response to the rotation of the pinion 133A, the hook portions 111A and 111B move upward (in the direction shown by arrows UP) along the inclined surfaces of the cam portions 128B and 128C. Accordingly, the guide rail 111 move in the direction shown by arrows UP.

Similar to the slide member 128, the slide member 126 is also provided with cam portions (not shown) which are inclined obliquely downward with respect to the direction shown by arrow +D, and hook portions (not shown) provided on the guide rail 109 are engaged with the cam portions. Although the slide member 126 has no rack, since the slide member 126 is integrated with the slide member 128 by the connecting member 129 (see FIG. 4), the slide member 126 moves in the direction shown by arrow +D when the slide member 128 moves in the direction shown by arrow +D. Accordingly, the hook portions move upward along the cam portions, and the guide rail 109 move upward in the direction shown by arrows UP.

As described above, when the slide members 126 and 128 move in the direction shown by arrow +D, the guide rails 109 and 111 move in the direction shown by arrows UP. Accordingly, the charging unit 100, which is retained'by the guide rails 109 and 111, is moved away from the outer peripheral surface of the photoconductor 62 in the direction shown by arrows UP.

Referring to FIG. 5A, when the image forming process is performed, the slide members 126 and 128 are moved in the direction shown by arrow −D with respect to the base plate 124 (see FIG. 4) so that the charging unit 100 is retained at a position where the charging unit 100 charges the outer peripheral surface of the photoconductor 62. When the grid electrode 104 (see FIG. 6A), which will be described below, is cleaned or when the charging unit 100 is attached to or detached from the image forming unit 14 (see FIG. 1), the slide members 126 and 128 are moved in the direction shown by arrow +D with respect to the base plate 124 (see FIG. 4). Accordingly, as illustrated in FIG. 5B, the charging unit 100 is retained at a position where the charging unit 100 is separated from the outer peripheral surface of the photoconductor 62. The base plate 124 (see FIG. 4) is not illustrated in FIGS. 5A and 5B.

Figure 6A:
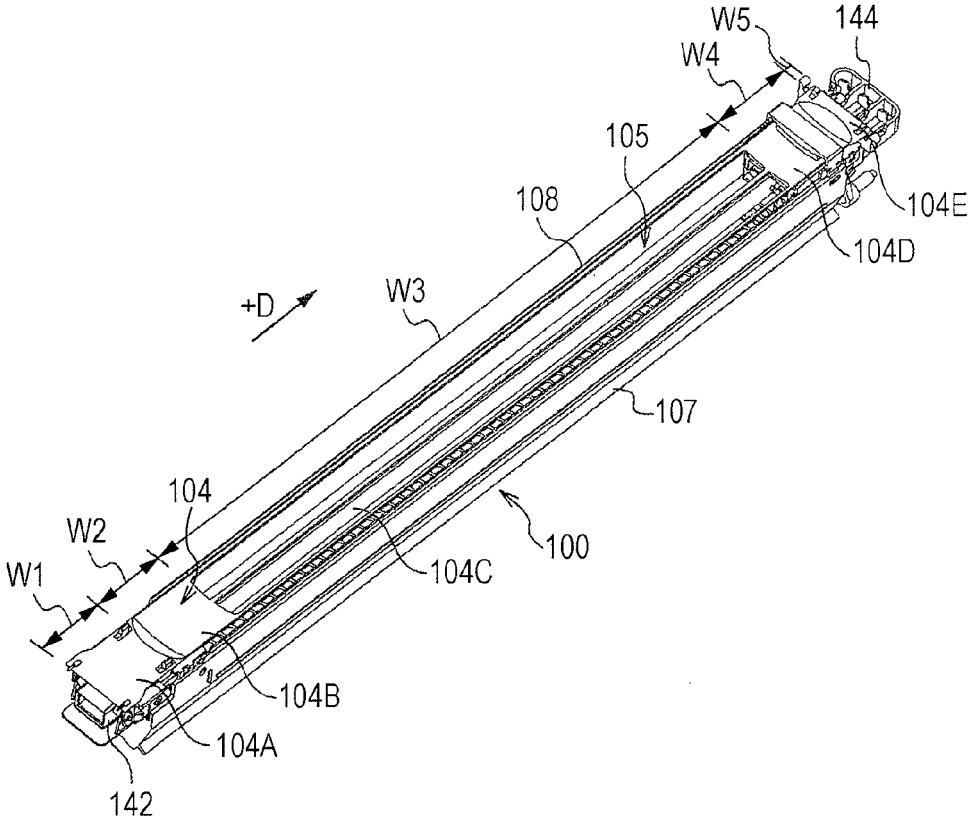
FIG. 6A is a perspective view of the charging unit according to the exemplary embodiment of the present invention.

As illustrated in FIG. 6A, attachment members 142 and 144 are attached to the shielding member 105 of the charging unit 100 at the ends thereof in the directions shown by arrows +D and −D. The attachment members 142 and 144 are used to retain the grid electrode 104. The attachment member 142 is provided at the front end in the direction opposite to the direction shown by arrow +D, and the attachment member 144 is provided at the back end in the direction shown by arrow +D.

The grid electrode 104 has a rectangular shape in plan view, and includes, in order from the front end to the back end in the direction shown by arrow +D, an attachment portion 104A having a width W1, a non-electrode portion 104B having a width W2, an electrode portion 104C having a width W3, a non-electrode portion 104D having a width W4, and an attachment portion 104E having a width W5, which are integrated with each other.

The grid electrode 104 is formed by subjecting a flat plate to a drawing process (press working) so that the plate is curved in the S-T plane (see FIG. 7B), as described below. More specifically, the non-electrode portion 104B, the electrode portion 104C, and the non-electrode portion 104D of the grid electrode 104 are examples of curved portions that project toward the charge wires 102A and 102B (see FIG. 3).

The attachment portions 104A and 104E of the grid electrode 104 are formed as flat portions. Referring to FIG. 7B, the curvature of the non-electrode portion 104B, the electrode portion 104C, and the non-electrode portion 104D is set such that a distance d to the outer peripheral surface of the photoconductor 62 is constant along the circumferential direction of the photoconductor 62. In other words, the non-electrode portion 104B, the electrode portion 104C, and the non-electrode portion 104D are curved along the outer peripheral surface of the photoconductor 62.

Figure 6B:
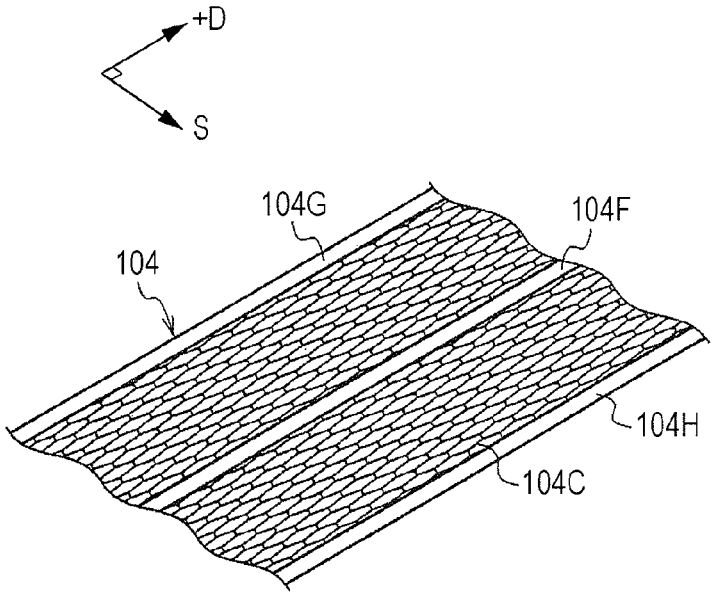
FIG. 6B illustrates the shape of an electrode portion of a grid electrode according to the exemplary embodiment of the present invention.

Referring to FIG. 6B, the electrode portion 104C of the grid electrode 104 has a mesh pattern including plural hexagonal holes. A frame portion 104F and frame portions 104G and 104H for increasing the rigidity are respectively formed at the center and sides of the electrode portion 104C in a direction shown by arrow S, that is, in the short-side direction orthogonal to the direction shown by arrow +D. Outermost parts of the frame portions 104G and 104H in the direction shown by arrow S are flush with the attachment portions 104A and 104E, which are flat. The electrode portion 104C is sectioned into two areas, which are an area surrounded by the frame portion 104G, the non-electrode portion 104B, the frame portion 104F, and the non-electrode portion 104D and an area surrounded by the frame portion 104F, the non-electrode portion 104B, the frame portion 104H, and the non-electrode portion 104D. The hexagonal holes in the electrode portion 104C are illustrated only in FIG. 6B, and are not illustrated in other figures.

Figure 7A:
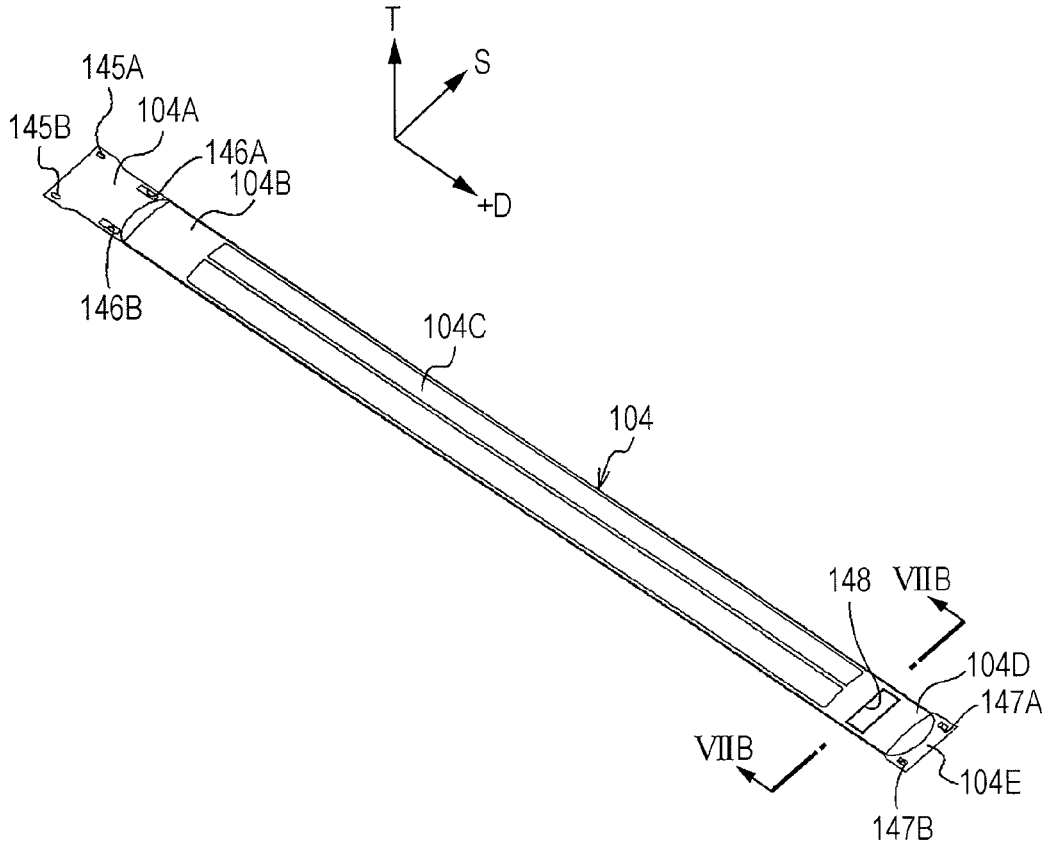
FIG. 7A is a perspective view illustrating the overall structure of the grid electrode according to the exemplary embodiment of the present invention.
Figure 7B:
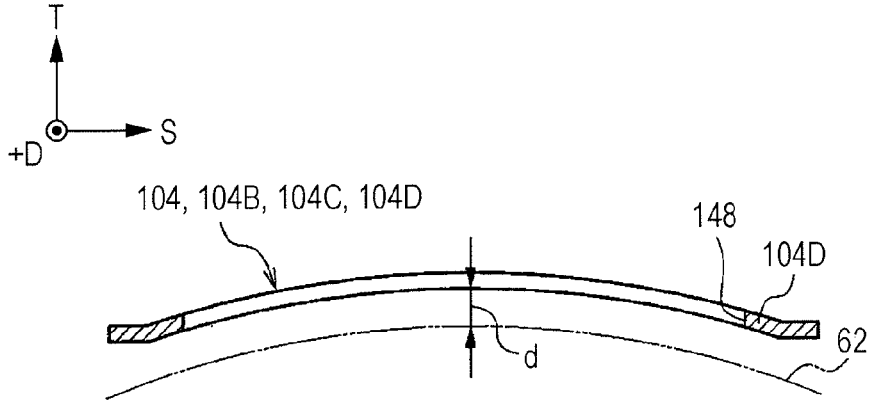
FIG. 7B is a sectional view of the grid electrode according to the exemplary embodiment of the present invention taken along a short-side direction.

As illustrated in FIG. 7A, the attachment portion 104A of the grid electrode 104 has attachment holes 145A and 145B and guide holes 146A and 146B, which are through holes that extend in a direction shown by arrow T (thickness direction), which is orthogonal to the direction shown by arrow +D and the direction shown by arrow S. The attachment holes 145A and 145B have a rectangular shape and are formed with an interval therebetween in the direction shown by arrow S at a first end of the grid electrode 104. The guide holes 146A and 146B have a rectangular shape and are formed with an interval therebetween in the direction shown by arrow S at positions near the non-electrode portion 104B. The attachment portion 104E has attachment holes 147A and 147B, which are through holes that extend in the direction shown by arrow T. The attachment holes 147A and 147B have a rectangular shape and are formed with an interval therebetween in the direction shown by arrow S at a second end of the grid electrode 104.

As illustrated in FIGS. 7A and 7B, the non-electrode portion 104D has a through hole 148, which is an example of a receiving portion. The through hole 148 that extends through the non-electrode portion 104D in the direction shown by arrow T. The through hole 148 has a rectangular shape that extends in the direction shown by arrow S, and is large enough to allow cleaning pads 166 and 172, which will be described below, to pass therethrough in the direction shown by arrow T.

Figure 8A:
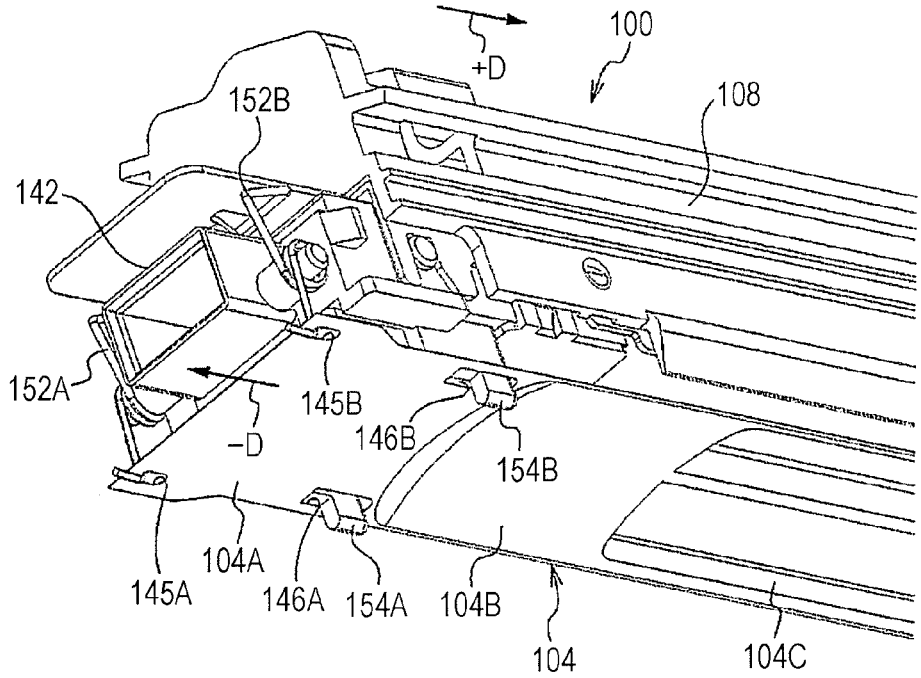
FIG. 8A illustrates one end portion of the charging unit according to the exemplary embodiment of the present invention.

As illustrated in FIG. 8A, the attachment member 142 is provided with spring members 152A and 152B that urge the grid electrode 104 in the direction shown by arrow −D and contact portions 154A and 154B that maintains the distance d between the grid electrode 104 and the photoconductor 62 (see FIG. 7B) constant. The spring members 152A and 152B may be, for example, torsion springs which are fixed to the attachment member 142 at one end thereof and engaged with the edges of the attachment holes 145A and 145B in the grid electrode 104 at the other end thereof. The contact portions 154A and 154B are inserted through the guide holes 146A and 146B, respectively, in the grid electrode 104 and project downward.

Figure 8B:
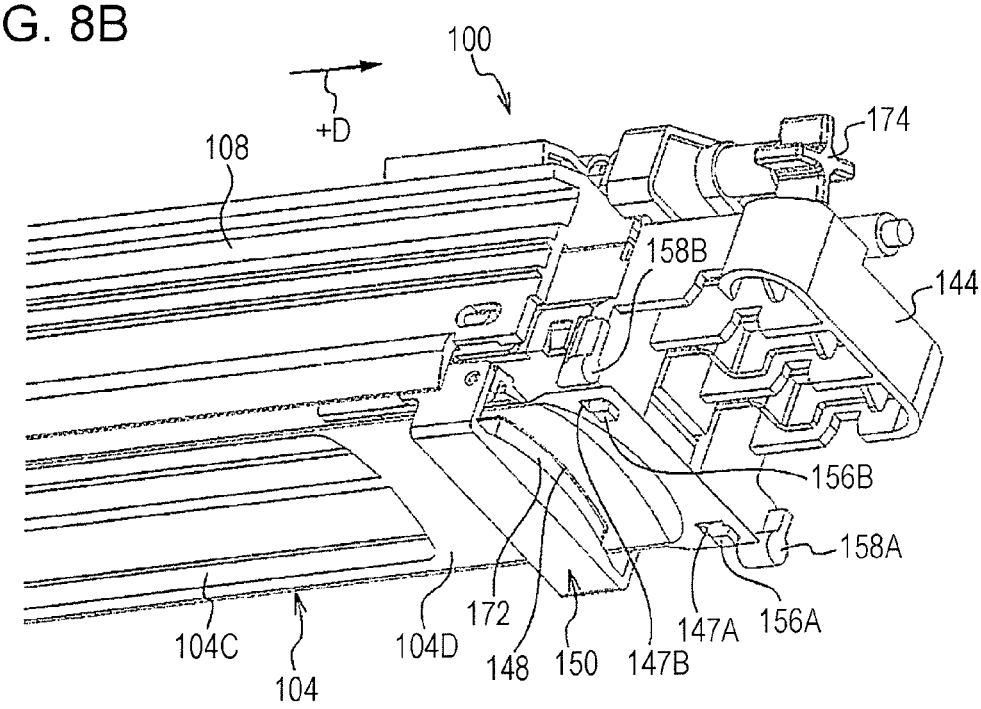
FIG. 8B illustrates the other end portion of the charging unit according to the exemplary embodiment of the present invention.

As illustrated in FIG. 8B, hook portions 156A and 156B that retain the second end of the grid electrode 104 and contact portions 158A and 158B that maintain the distance d between the grid electrode 104 and the photoconductor 62 (see FIG. 7B) constant are provided at the bottom of the attachment member 144. The hook portions 156A and 156B are bent in the direction shown by arrow +D, and the size thereof is set such that the hook portions 156A and 156B are insertable through the attachment holes 147A and 147B, respectively, in the grid electrode 104. The contact portions 158A and 158B are disposed outside the grid electrode 104 in the short-side direction of the grid electrode 104, and project downward.

Referring to FIGS. 8A and 8B, the grid electrode 104 is attached to the charging unit 100 by respectively engaging the spring members 152A and 152B with the attachment holes 145A and 145B in the grid electrode 104, respectively inserting the contact portions 154A and 154B through the guide holes 146A and 146B while pulling the grid electrode 104 in the direction shown by arrow +D, and respectively engaging the hook portions 156A and 156B with the attachment holes 147A and 147B. The contact portions 154A, 154B, 158A, and 158B are brought into contact with top portions of holders (not shown) provided at the ends of the photoconductor 62 (see FIG. 7B), so that the distance d between the photoconductor 62 and the grid electrode 104 is maintained constant.

Next, the grid cleaner 150 will be described.

Figure 9A:
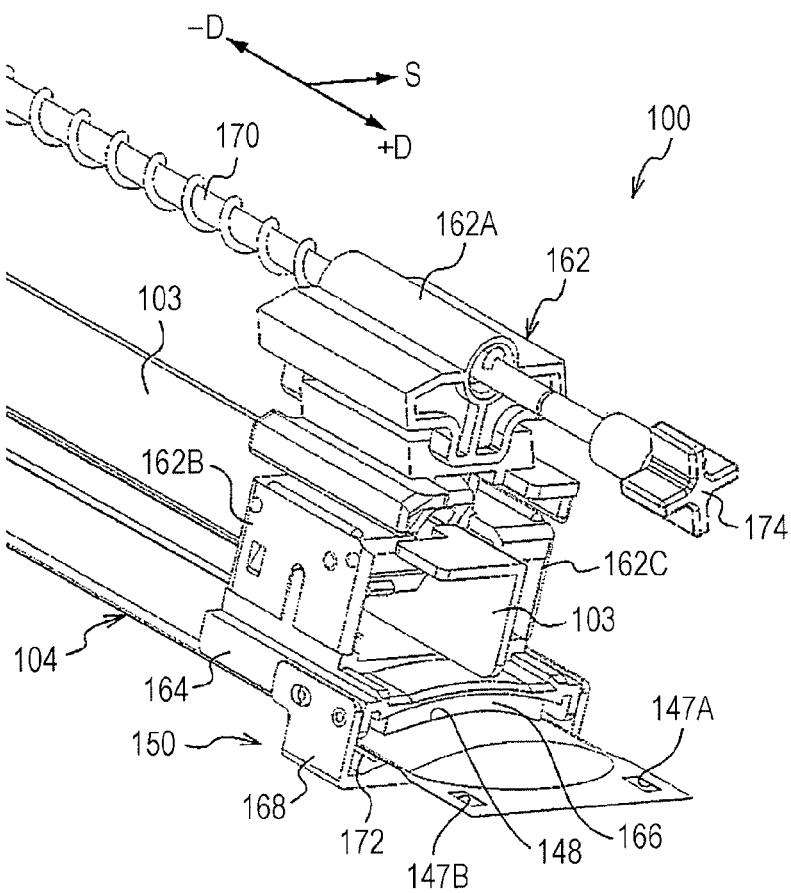
FIGS. 9A and 9B are a perspective view and a sectional view, respectively, of a grid cleaner of the charging unit according to the exemplary embodiment of the present invention.

As illustrated in FIG. 9A, a lead shaft 170 is rotatably disposed in the charging unit 100 such that the axial direction thereof extends in the direction shown by arrow +D. A cross-shaped coupling portion 174 is provided at an end of the lead shaft 170. The coupling portion 174 engages with another coupling portion (not shown) provided on the side plate 122 (see FIG. 4). The lead shaft 170 is rotated when the coupling portion on the side plate 122 is rotated by a motor (not shown).

The grid cleaner 150 is provided in the charging unit 100. The grid cleaner 150 moves in the direction shown by arrow +D or the direction shown by arrow −D in response to the rotation of the lead shaft 170. The grid cleaner 150 includes a base holder 162 through which the lead shaft 170 extends; a wire holder 164 attached to a bottom portion of the base holder 162; a pad holder 168 attached to a bottom portion of the wire holder 164; the cleaning pad 166 provided to clean the top surface of the grid electrode 104; and the cleaning pad 172 provided to clean the bottom surface of the grid electrode 104 (surface that faces the photoconductor 62 (see FIG. 2)).

A cylindrical portion 162A in which internal helical grooves (not shown) are formed is provided integrally with the base holder 162 at the top thereof. The lead shaft 170 is inserted through the cylindrical portion 162A such that projections on the outer periphery of the lead shaft 170 are in contact with the grooves in the cylindrical portion 162A. Accordingly, when the lead shaft 170 is rotated in a normal or reverse direction, the base holder 162 is moved in the direction shown by arrow −D or the direction shown by arrow +D. Side walls 162B and 162C that project downward at the ends of the base holder 162 in the direction shown by arrow S are provided at the bottom thereof. The shielding member 105 (see FIG. 9B) is disposed outside the side walls 162B and 162C.

Figure 9B:
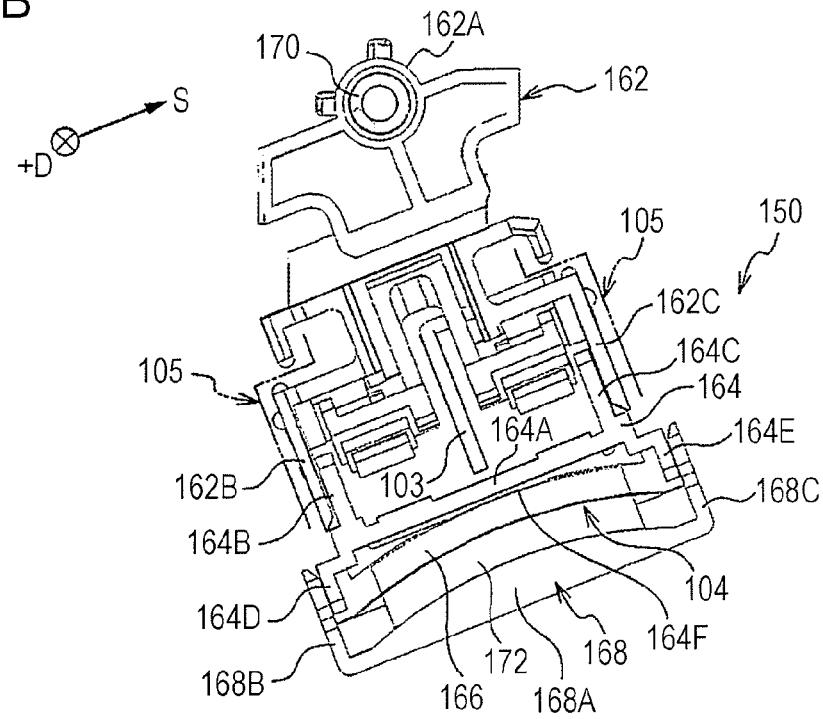

As illustrated in FIG. 9B, the wire holder 164 includes a flat-plate-shaped base body 164A, and side walls 164B and 164C stand on the top surface of the base body 164A with an interval therebetween in the direction shown by arrow S. The side walls 164B and 164C are attached to the side walls 162B and 162C, respectively, of the base holder 162 with engagement members (not shown). Side walls 164D and 164E that project downward from the bottom surface of the base body 164A are provided integrally with the base body 164A at the ends thereof in the direction shown by arrow S. A concave portion 164F that is curved so as to face downward is provided on the base body 164A at a position between the side walls 164D and 164E (at a central area) in the direction shown by arrow S. The cleaning pad 166 is fixed to the concave portion 164F by adhesion.

The pad holder 168 has a convex portion 168A that is curved so as to project upward at a central area thereof in the direction shown by arrow S. Side walls 168B and 168C that face each other with an interval therebetween in the direction shown by arrow S are provided so as to stand at the ends of the convex portion 168A in the direction shown by arrow S. The side walls 168B and 168C are attached to the side walls 164D and 164E, respectively, of the wire holder 164 with engagement members (not shown). The cleaning pad 172 is fixed to the convex portion 168A by adhesion. The cleaning pads 166 and 172 are made of, for example, a material including polyurethane, which is an expandable resin material.

Figure 10A:
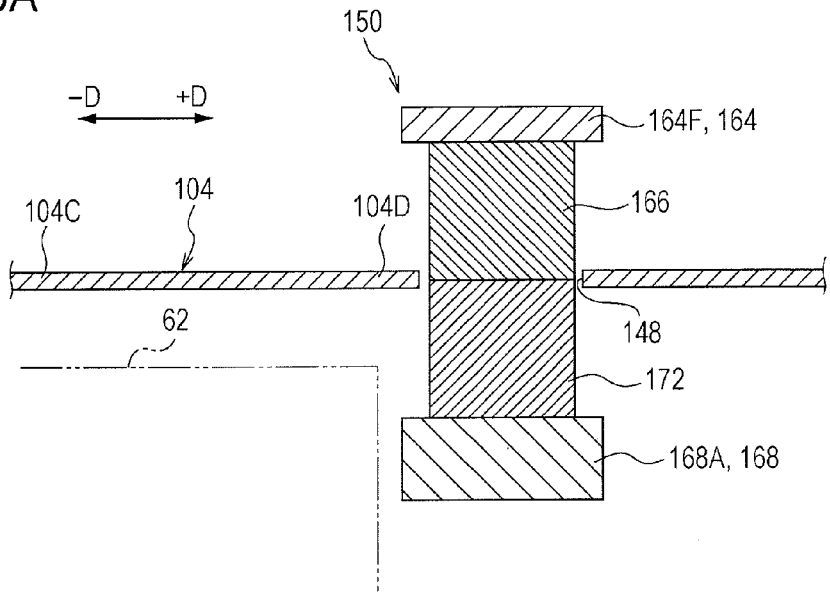
FIGS. 10A and 10B are sectional views illustrating the manner in which the grid electrode is cleaned by cleaning pads according to the exemplary embodiment of the present invention.

Referring to FIG. 10A, the cleaning pads 166 and 172 are located at the same position in the direction shown by arrow +D and face each other in the vertical direction. When the image forming process is performed by the image forming apparatus 10 (see FIG. 1), the grid cleaner 150 is positioned at an initial position that corresponds to the non-electrode portion 104D. When the grid cleaner 150 is at the initial position, the grid cleaner 150 is located outside the photoconductor 62 (shown by two-dot chain lines) in the axial direction thereof, that is, in the direction shown by arrow +D. Therefore, the grid cleaner 150 does not come into contact with the photoconductor 62.

When the grid cleaner 150 is at the initial position, the cleaning pads 166 and 172 are in the through hole 148. When the grid cleaner 150 is at this initial position, the bottom surface of the cleaning pads 166 and 172 are in contact with each other.

The operation of the present exemplary embodiment will now be described.

Referring to FIGS. 5A and 5B, when a process of cleaning the grid electrode 104 is performed in the image forming apparatus 10 (see FIG. 1), the motor 132 is driven by the controller 20 (see FIG. 1) so that the slide members 126 and 128 are moved in the direction shown by arrow +D and the guide rails 109 and 111 are moved in the direction shown by arrows UP. Accordingly, the charging unit 100 is moved upward away from the outer peripheral surface of the photoconductor 62.

Figure 10B:
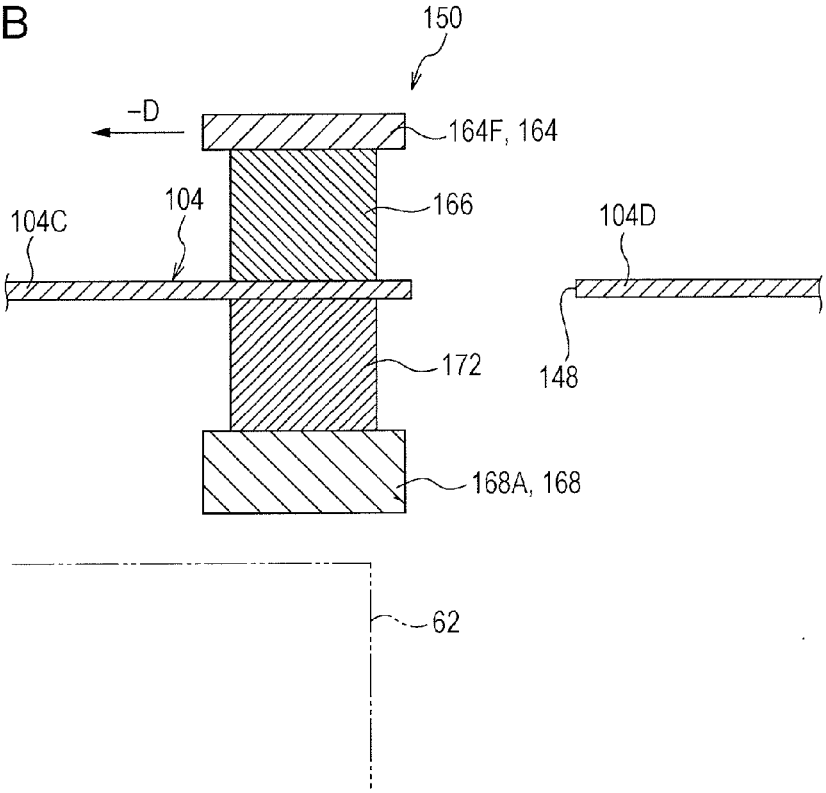
Figure 11A:
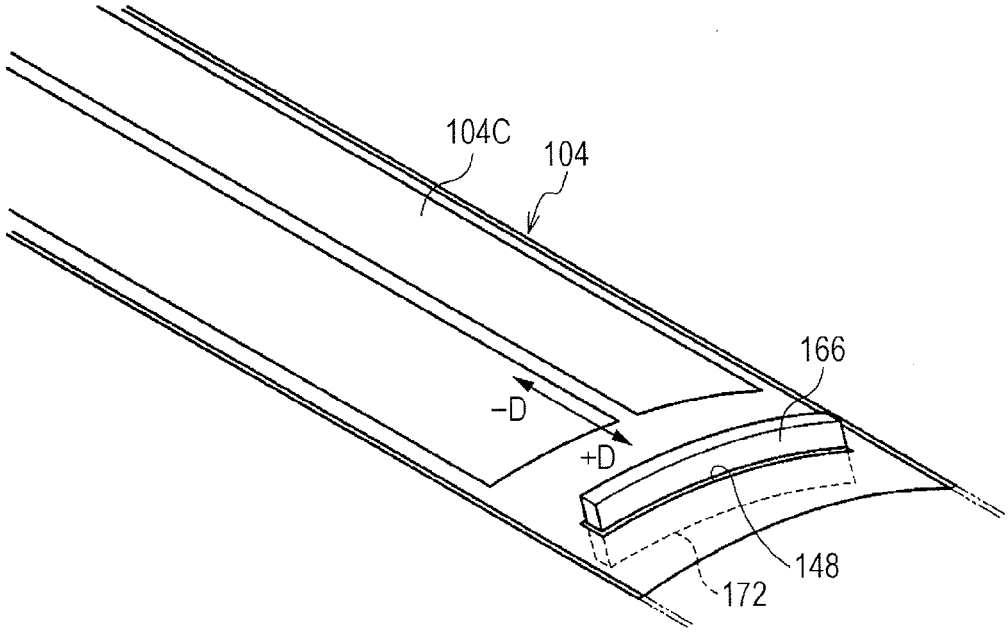
FIGS. 11A and 11B are perspective views illustrating the manner in which the grid electrode is cleaned by the cleaning pads according to the exemplary embodiment of the present invention.
Figure 11B:
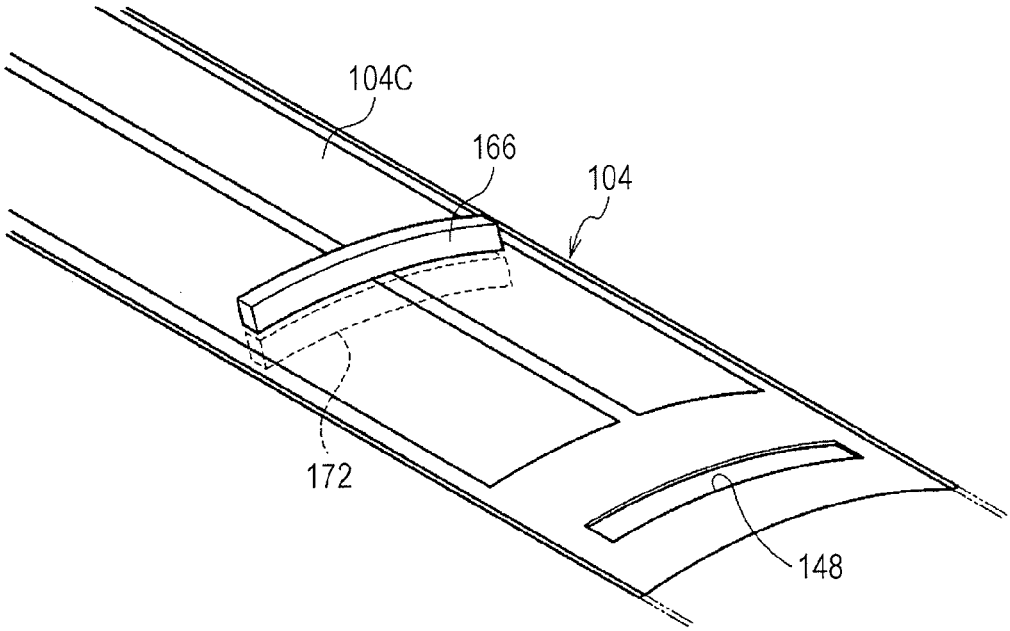

Then, the lead shaft 170 (see FIG. 9A) is rotated in the normal direction so that the grid cleaner 150 is moved in the direction shown by arrow −D from the initial position thereof, as illustrated in FIGS. 10B and 11B. When the grid cleaner 150 is moved, the cleaning pad 166 is moved in the direction shown by arrow −D while being compressed between the concave portion 164F and the top surface of the grid electrode 104, and the cleaning pad 172 is moved in the direction shown by arrow −D while being compressed between the convex portion 168A and the bottom surface of the grid electrode 104. After the grid cleaner 150 reaches the first end of the grid electrode 104, the grid cleaner 150 is moved in the direction shown by arrow +D. Accordingly, the cleaning pads 166 and 172 remove toner and paper dust that adhere to the electrode portion 104C, and both sides of the grid electrode 104 are cleaned.

After the process of cleaning the grid electrode 104 is ended, the grid cleaner 150 returns to the initial position, as illustrated in FIGS. 10A and 11A. At this position, the cleaning pads 166 and 172 are placed in the through hole 148. Then, referring to FIGS. 5A and 5B, the motor 132 is rotated in the reverse direction by the controller 20 (see FIG. 1) so that the slide members 126 and 128 are moved in the direction shown by arrow −D and the guide rails 109 and 111 are moved downward. Accordingly, the charging unit 100 is moved to a position where the charging unit 100 is opposed to the outer peripheral surface of the photoconductor 62.

As illustrated in FIG. 10A, when the grid electrode 104 is not being cleaned, the cleaning pads 166 and 172 are placed in the through hole 148 and are not in contact with the grid electrode 104. Therefore, the grid electrode 104 is prevented from continuously receiving a contact pressure (load) from the cleaning pads 166 and 172 (contact pressure is reduced). Accordingly, deformation of the grid electrode 104 is reduced and the grid electrode 104 is appropriately maintained in a curved state. In other words, a distance between the electrode portion 104C and the photoconductor 62 is maintained within an allowable range. Since the distance between the electrode portion 104C and the photoconductor 62 is maintained, variation in the charging state (surface potential) of the photoconductor 62 is reduced. As a result, unevenness in image density may be reduced.

The present invention is not limited to the above-described exemplary embodiment.

Figure 12A:
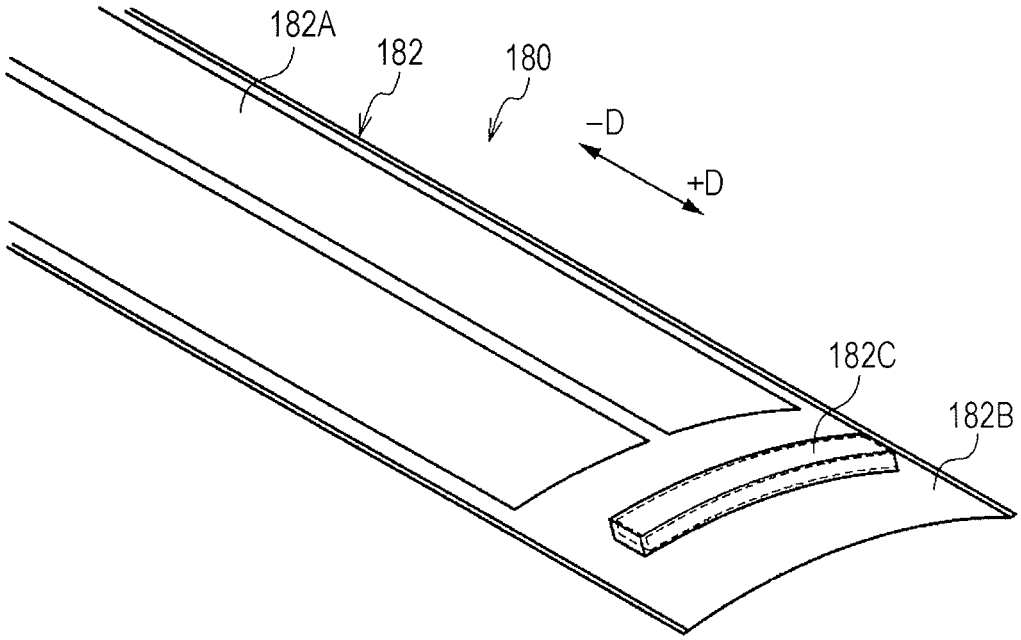
FIG. 12A illustrates a receiving portion formed in a grid electrode to receive a cleaning pad according to a modification of the exemplary embodiment of the present invention.
Figure 12B:
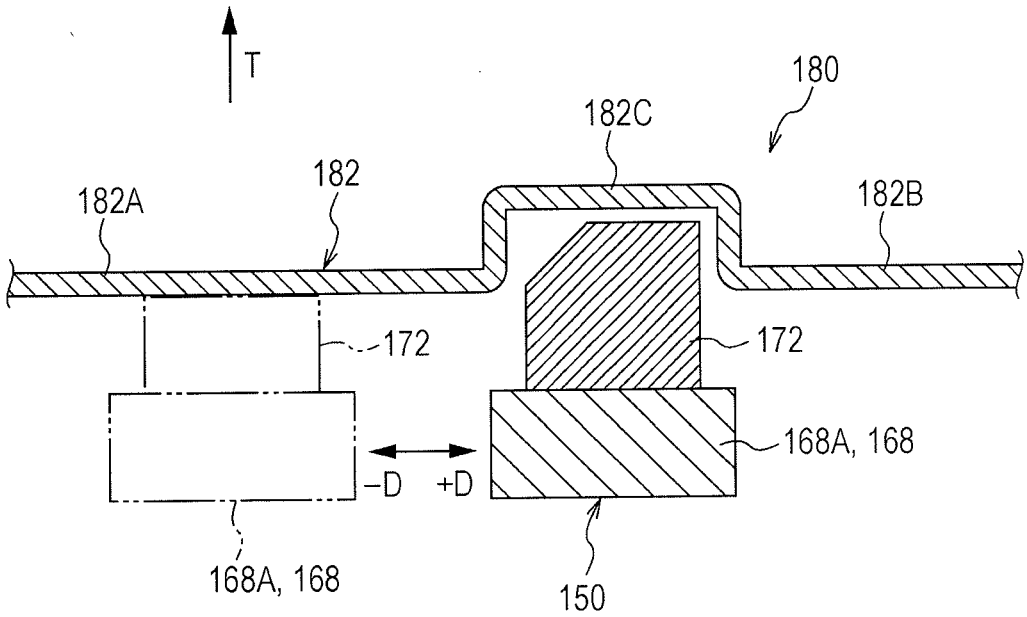
FIG. 12B is a sectional view illustrating the manner in which the cleaning pad is placed in the receiving portion of the grid electrode according to the modification of the exemplary embodiment of the present invention.

As a modification of the charging unit 100, a charging unit 180 illustrated in FIGS. 12A and 12B may be used as an example of a charging device in which the cleaning pad 166 is not included and the cleaning pad 172 is used. Referring to FIGS. 12A and 12B, the charging unit 180 differs from the above-described charging unit 100 (see FIGS. 9A and 9B) in that the charging unit 180 includes a grid electrode 182 instead of the grid electrode 104 as an example of an electrode member, and the cleaning pad 166 is removed from the grid cleaner 150.

The grid electrode 182 includes an electrode portion 182A (example of an electrode) having a mesh pattern that is similar to the above-described electrode portion 104C (see FIG. 6B) and a non-electrode portion 182B. The electrode portion 182A and the non-electrode portion 182B function as a curved portion. A receiving portion 182C is formed integrally with the non-electrode portion 182B. The receiving portion 182C is not a through hole, but is a recessed portion that projects in the direction shown by arrow T and opens at the bottom. The receiving portion 182C is disposed at the initial position of the grid cleaner 150. When the grid cleaner 150 is at the initial position, the inner wall of the receiving portion 182C and the top surface of the cleaning pad 172 are not in contact with each other, or are in contact with each other such that substantially no load is applied to the cleaning pad 172.

Referring to FIG. 12B, in the charging unit 180, when the grid cleaner 150 is moved in the direction shown by arrow −D, the cleaning pad 172 is moved in the direction shown by arrow −D while being compressed between the convex portion 168A and the bottom surface of the grid electrode 182 (see two-dot chain lines in FIG. 12B). After the grid cleaner 150 reaches a first end of the grid electrode 182, the grid cleaner 150 is moved in the direction shown by arrow +D. Accordingly, the cleaning pad 172 removes toner and paper dust that adhere to the electrode portion 182A, and the grid electrode 182 is cleaned. After the process of cleaning the grid electrode 182 is ended, the grid cleaner 150 returns to the initial position and the cleaning pad 172 is placed in the receiving portion 182C.

When the grid cleaner 150 is at the initial position, the cleaning pad 172 is placed in the receiving portion 182C.

Therefore, the cleaning pad 172 is not in contact with the grid electrode 182, or is in contact with the grid electrode 182 such that substantially no load is applied between the cleaning pad 172 and the grid electrode 182. Accordingly, the grid electrode 182 is prevented from continuously receiving a contact pressure (load) from the cleaning pad 172, so that deformation of the grid electrode 104 is reduced and the grid electrode 104 is maintained in a curved state. Thus, a distance between the electrode portion 182A and the photoconductor 62 is maintained. Since the distance between the electrode portion 182A and the photoconductor 62 is maintained, variation in the charging state (surface potential) of the photoconductor 62 is reduced. As a result, unevenness in image density may be reduced.

When the grid cleaner 150 is at the initial position, the inner wall of the receiving portion 182C and the top surface of the cleaning pad 172 axe not in contact with each other, or are in contact with each other such that substantially no load is applied therebetween. Therefore, deformation of the cleaning pad 172 itself may also be reduced.

As another modification, the cleaning pad 172 may be omitted and the receiving portion 182C may be formed in an inverted orientation. In such a case, the grid electrode 182 is cleaned by the cleaning pad 166.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A charging device comprising:

a charging member that charges an outer peripheral surface of a cylindrical latent-image carrier;

an electrode member including a curved portion that is formed by press working so as to extend along the outer peripheral surface of the latent-image carrier, the curved portion having an electrode to which a voltage is applied, the electrode being disposed between the charging member and the latent-image carrier;

a cleaning member that is movable along the curved portion in an axial direction of the latent-image carrier and that cleans the electrode; and a receiving portion formed in the curved portion at a position outside the electrode, the receiving portion receiving the cleaning member to release a contact pressure between the curved portion and the cleaning member.

2. The charging device according to claim 1, wherein the cleaning member is provided at each side of the curved portion in a thickness direction of the curved portion, and wherein the receiving portion is a through hole formed in the curved portion.

3. An image forming apparatus comprising: the charging device according to claim 2;

wherein the latent-image carrier carries a latent image formed by irradiation with light, and wherein the image forming apparatus further comprises:

a developing unit that develops the latent image with developer to form a developer image; and a transfer unit that transfers the developer image onto a recording medium.

4. An image forming apparatus comprising:

the charging device according to claim 1;

wherein the latent-image carrier carries a latent image formed by irradiation with light, and wherein the image forming apparatus further comprises:

a developing unit that develops the latent image with developer to form a developer image; and a transfer unit that transfers the developer image onto a recording medium.

* * * * *